US007980807B2

(12) United States Patent
Schoenauer

(10) Patent No.: US 7,980,807 B2
(45) Date of Patent: Jul. 19, 2011

(54) LOAD-HANDLING MEANS WITH ROLLING-BODY CIRCULATORY GUIDANCE

(75) Inventor: Michael Schoenauer, Moosburg (DE)

(73) Assignee: Jungheinrich Aktiengesellschaft, Hamburg (DE)

( * ) Notice: Subject to any disclaimer, the term of this patent is extended or adjusted under 35 U.S.C. 154(b) by 444 days.

(21) Appl. No.: 12/030,489

(22) Filed: Feb. 13, 2008

(65) Prior Publication Data

US 2008/0193268 A1 Aug. 14, 2008

(30) Foreign Application Priority Data

Feb. 14, 2007 (DE) ..... 10 2007 007 359

(51) Int. Cl.
*B66F 9/14* (2006.01)

(52) U.S. Cl. ..... 414/663; 414/667; 414/671; 198/468.6

(58) Field of Classification Search ..... 414/663, 414/665, 666, 667, 671; 198/468.6
See application file for complete search history.

(56) References Cited

U.S. PATENT DOCUMENTS

| | | | | |
|---|---|---|---|---|
| 5,190,436 | A * | 3/1993 | Sorlie | 414/667 |
| 6,409,633 | B1 * | 6/2002 | Abelbeck | 482/54 |
| 7,275,908 | B2 * | 10/2007 | Hill et al. | 414/669 |
| 2007/0014655 | A1 * | 1/2007 | Tygard | 414/663 |
| 2007/0023259 | A1 | 2/2007 | Schonauer | |

FOREIGN PATENT DOCUMENTS

| | | | |
|---|---|---|---|
| DE | 23 17 758 | A1 | 10/1974 |
| DE | 102004007292 | A1 | 9/2005 |
| DE | 10 2005 035631 | A1 | 2/2007 |
| EP | 0658510 | | 6/1995 |
| EP | 0658610 | A1 | 6/1995 |

OTHER PUBLICATIONS

G. Blaurock, "Roller Guides and Accessories for Linearly Driven Machine Parts", Magazine Article in Maschinenmarkt, 82, 1976, 49, pp. 955-956. (Abstract).

G. Blaurock, "Survey of Linear Guides with Rolling Element Revolution", Magazine Article in Forschung and Konstruktion, 82, 1976, 53, pp. 874-877. (Abstract).

Baus et al., Leichte Lager fur schwere Lasten, a magazine article published in Sonderteil in Hanser-Fachzeitschriften, Dec. 7, 1992 (Abstract).

* cited by examiner

*Primary Examiner* — Michael S Lowe
(74) *Attorney, Agent, or Firm* — Rothwell, Figg, Ernst & Manbeck, P.C.

(57) ABSTRACT

A load-handling apparatus having a frame and a load movement component part accommodated on said frame in such a way that it is capable of relative movement, the load movement component part being guided on the frame by a plurality of rolling bodies for the relative movement along a guide axis, the plurality of rolling bodies comprising at least one arrangement of circulating rolling bodies, with a supporting section, in which rolling bodies in the event of a relative movement of the frame and the load movement component part roll along a guide track and a rolling track, and a return section, in which the rolling bodies during the relative movement of the frame and the load movement component part move from an outlet end region of the supporting section towards its inlet end region.

29 Claims, 3 Drawing Sheets

LOAD-HANDLING MEANS WITH ROLLING-BODY CIRCULATORY GUIDANCE

Figure 1:
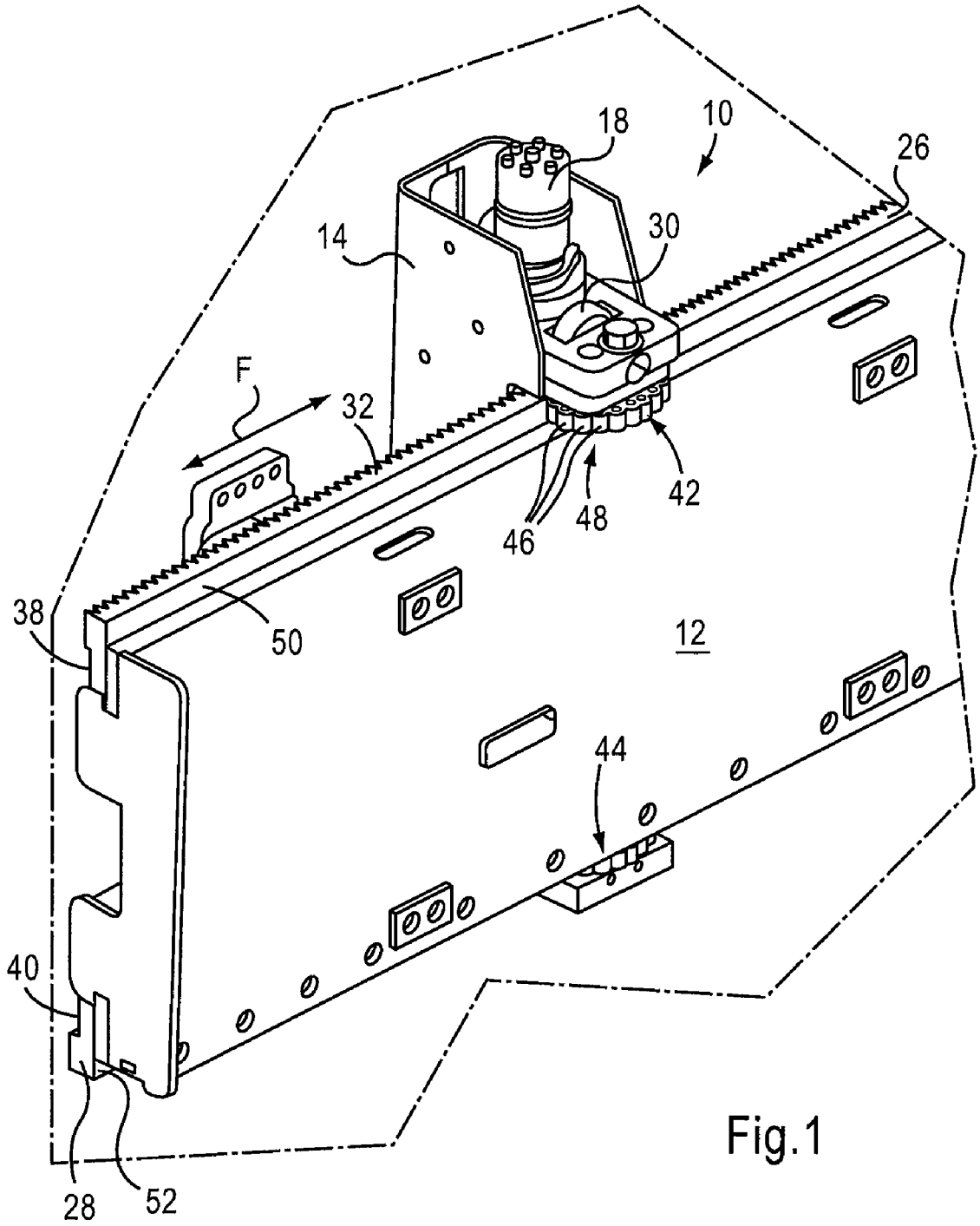

The present invention relates to a load-handling means with a frame and a load movement component part, which is accommodated on said frame in such a way that it is capable of relative movement, the load movement component part being guided on the frame by means of a plurality of rolling bodies for the relative movement along a guide axis. Since such load-handling means are particularly suitable for use on industrial trucks, the present application likewise relates to an industrial truck with such a load-handling means.

An example of a load-handling means of the generic type are sideshifters on industrial trucks, in the case of which an outrigger is accommodated and guided in such a way that is capable of relative movement on a side-shifting frame, which is fixedly connected to the industrial truck, and movably along a guide axis. In this case, a plurality of rolling bodies, generally rollers, are provided which mount the outrigger movably on the side-shifting frame and absorb corresponding bearing forces. Usually, the outrigger is fixed in a statically overdetermined manner on the side-shifting frame since the advantages of such a mounting system, namely the outrigger being accommodated precisely and without play on the side-shifting frame, overcompensate for the disadvantages of the static overdeterminacy, namely the inability to determine bearing forces and, associated with this, possible distortion.

In order to mount and guide the outrigger on the side-shifting frame, inter alia pairs of rollers with parallel roller axes are used in order to prevent the outrigger from tipping relative to the side-shifting frame about a tipping axis parallel to the roller axes. One disadvantage with this configuration is the restriction of the movement area of the outrigger relative to the side-shifting frame caused by the distance between the rolling points of the axially parallel rollers in the direction of the guide axis.

In accordance with that which has been mentioned above, it is the object of the present invention to provide a load-handling means of the type mentioned at the outset which allows for a larger movement path of the load movement component part relative to the frame given the same guidance accuracy and otherwise substantially the same dimensions of the load movement component part and the frame.

This object is achieved according to the invention by a generic load-handling means, in which the plurality of rolling bodies comprises at least one arrangement of circulating rolling bodies, with a supporting section, in which rolling bodies in the event of a relative movement of the frame and the load movement component part roll along a guide track, which is fixedly connected to one component part of the frame and the load movement component part, and a rolling track, which is fixedly connected to the respective other component part of the frame and the load movement component part, and with a return section, in which the rolling bodies during the relative movement of the frame and the load movement component part move from an outlet end region of the supporting section towards its inlet end region.

The arrangement of circulating rolling bodies can replace the axially parallel pair of rollers known from the prior art. Owing to the plurality of circulating rolling bodies which roll in a supporting section, in which the rolling bodies roll under load both on the frame and on the load movement component part, the load to be accommodated by the supporting section can be distributed over a plurality of rolling bodies since there is always more than two rolling bodies located in the supporting section. As a result, given a slight surface pressure on the individual rolling body and a corresponding selection of the size dimensions of the rolling bodies, the supporting section can be designed to be shorter in the direction of the guide axis than the distance between the rolling points of two axially parallel rollers in accordance with the prior art. Correspondingly, the load movement component part can be extended relative to the frame along the guide axis without the mounting and guidance situation of the load movement component part on the frame changing.

Owing to the fact that the guide loading is split between a plurality of rolling bodies, it is even possible to travel over the end of the guide track, with the result that some of the rolling bodies which are at that time present in the supporting section come out of rolling engagement with the guide track. As a result, the relative movement path between the load movement component part and the frame along the guide axis can be extended further still in comparison with the prior art without the guidance of the load movement component part on the frame being notably impaired. For short periods of time, it may be sufficient for only some of the rolling bodies provided in the supporting section to be in rolling contact with the guide track. It is therefore possible for a short time to travel over the end of the guide track at least to such an extent that at least half or more of all of the rolling bodies provided in the supporting section still remain in rolling contact with the guide track.

Furthermore, owing to the fact that the guide loading is split between a plurality of rolling bodies and the surface pressure on the individual rolling body is therefore reduced, said rolling body can be designed to have a smaller contact area with the guide track, so that a narrower guide track can be used in comparison with the prior art.

"Outlet end region" and "inlet end region" of the supporting section in this case denote those regions in which the rolling bodies leave the supporting section having passed through it or in which they enter the supporting section again once they have returned. The return section ensures that a rolling body which, having passed through the supporting section, comes out of rolling contact with the guide track is returned to the start of the supporting section again in order to pass through the supporting section again. The direction of the rolling body passage through the supporting section and the return section in this case depends on the relative movement direction between the load movement component part and the frame.

An advantageous, compact guide component part which supports the arrangement of circulating rolling bodies can be formed by virtue of the fact that the at least one arrangement of circulating rolling bodies surrounds at least sections of a shaped component part, which has the rolling track, on which at least some of the circulating rolling bodies roll in the event of a relative movement of the frame and the load movement component part.

It is in principle conceivable that the rolling bodies only roll in the supporting section between the guide track and the rolling track, while, in the return section, they are conveyed substantially without any defined contact with a rolling body guide to the inlet end region of the supporting section. However, it is preferred for the rolling bodies to roll at least on sections of the rolling track in the return section as well, in order thus to achieve a defined return movement of the rolling bodies. For this purpose, the rolling track can be in the form of a continuous track closed in the rolling direction.

Depending on the configuration of the rolling track, it may arise in particular in the case of different radii of curvature of the rolling track in the rolling direction that rolling bodies temporarily lift off from the rolling track. However, this results in undesirable noises and mechanical loadings. A sufficient ordered return of the rolling bodies can be ensured if at least two thirds of the circulating rolling bodies are continuously in rolling contact with the rolling track. For the abovementioned reasons, however, it is preferred for all of the circulating rolling bodies to be in touching contact with the rolling track.

Since in most cases the relative movement between the load movement component part and the frame is a linear translatory movement, it is advantageous if the rolling track has a linear track section associated with the supporting section.

Depending on the load conditions in the supporting section, it may be necessary for the return section to be designed to be longer than the supporting section in order to provide as large a number of rolling bodies as possible in the rolling body cycle. This can be realized by virtue of the fact that the rolling track has a track section, at least sections of which, but preferably all of which is curvilinear and which is associated with the return section. The curvilinearity of the track section is in this case a curvilinearity in the rolling direction or rolling body conveyance direction.

Particularly simple fitting with at the same time a defined arrangement of circulating rolling bodies can be attained by virtue of the fact that the at least one arrangement of circulating rolling bodies is at least one rolling body chain. Precisely in the case of rolling body chains in which the distances between the rolling bodies are generally substantially fixed by chain links, different radii of curvature of the rolling track on the shaped component part can result in rolling bodies temporarily lifting off from the rolling track during the cycle, as mentioned above.

The rolling body chain can be fitted in a particularly simple manner if it is a continuous chain. However, in this case the gap between the open ends of the rolling body chain during a rolling body cycle can vary depending on the design of the rolling track. If this is not desirable, a continuous rolling body chain closed in the rolling direction can also be used.

Particularly preferably, a slat chain is used as the rolling body chain since this is dimensioned to be only insubstantially larger in the direction of the rolling-body axis of rotation than the rolling bodies themselves and at the same time provides sufficient strength.

A sufficiently movable slat chain can be attained by virtue of the fact that two slats are associated with one rolling body and two rolling bodies are associated with one slat. This applies to each rolling body of the rolling body chain with two rolling bodies adjacent in the direction of the chain extent, i.e. in the case of a continuous rolling body chain for each rolling body and in the case of a finite rolling body chain for each rolling body apart from the two end rolling bodies.

In order to be able to ensure a defined positional relationship between the rolling bodies and the shaped component part, in particular the rolling track on the shaped component part, it can be provided that the slat chain has guide means, which engage with opposing guide means on the shaped component part for the purpose of guiding the slat chain on the shaped component part in the rolling direction. This can take place in a particularly simple manner in terms of design by virtue of the fact that at least some of the slats, preferably all of the slats, of the slat chain have a guide tab pointing towards the shaped component part. Less preferably, the guide tab can be fitted subsequently to the slats. From a manufacturing point of view it is preferred if the guide tab is formed integrally on slats of the slat chain.

The most common case of a slat chain is a slat chain with two parallel rows of slats, between which the rolling bodies of the slat chain are arranged. These slat chains are sufficiently movable at least when two slats are associated with each rolling body at each longitudinal end and two rolling bodies are associated with each slat. This applies, as described above, in turn to each rolling body with two rolling bodies adjacent in the direction of the chain extent. Such slat chains are particularly suitable for position fixing with respect to the rolling track if at least some of the slats of each row of slats have guide tabs, so that at least one section of the rolling track, preferably the entire rolling track, of the shaped component part is located between the guide tabs of slats of the two rows of slats.

The opposing guide means on the shaped component part can, in a very simple manner, be in the form of a resting face for resting guide tabs on it.

Since slats of a slat chain are generally in the form of flat component parts which are oriented orthogonally with respect to the parallel axes of rotation of the rolling bodies of the slat chain, preferably the at least one resting face is bent back at an angle with respect to the rolling face of the rolling track.

When the slat chain with the two parallel rows of slats is used, the shaped component part can have two resting faces, which are arranged at a distance from one another, each resting face having associated guide tabs of a row of slats. The resting faces, between which the rolling track runs, preferably enclose an angle with the rolling face of the rolling track. This angle can be a right angle or it can be slightly, i.e. 1° to 10°, preferably 2° to 5°, larger than a right angle, so that it is easier to attach the slat chains to the shaped component part. The angle enclosed between the resting face and the rolling face of the rolling track can therefore be conventional draft angles larger than a right angle.

Particularly easy guidance is attained by virtue of the fact that the at least one resting face is formed from plastic. A resting face made from polytetrafluoroethylene has proven to be particularly suitable as a low-friction sliding layer.

Likewise, at least some of the rolling bodies, but preferably all of the rolling bodies, are mounted by means of a sliding-bearing face made from plastic so as to rotate about their respective rolling-body axis of rotation. In turn, in this case polytetrafluoroethylene has proven to be a particularly low-friction plastic. As a result of the plastic sliding-bearing face of the rolling bodies and also as a result of the plastic resting face, the guidance with the arrangement of circulating rolling bodies of the load-handling means according to the invention attains excellent emergency-running properties, which make it possible to continue operation of the load-handling means even in the event of failure of a lubricant supply.

In a particularly simple manner, those of the rolling bodies which are mounted by means of a plastic sliding-bearing face for rotation purposes can be accommodated by means of an intermediate arrangement of a sliding-bearing sleeve on a bolt running in the direction of the rolling-body axes of rotation. As is known per se, the bolt can at the same time be used for connecting the two rows of slats.

As has already been mentioned at the beginning, the load-handling means according to the invention is particularly advantageous as a side-shifting device. In this case, the abovementioned frame is a shifting frame, and the abovementioned load movement component part is an outrigger, which is accommodated on the shifting frame in such a way that it is capable of moving relative thereto. However, the possibility of the load-handling means also being suitable for other applications for displacing goods, in particular on industrial trucks, should not be ruled out.

For drive purposes, in this preferred embodiment of the present invention at least one drivable drive means can be provided on one component part of the shifting frame and the outrigger, preferably on the outrigger, and a driven means is provided on the respective other component part, preferably on the shifting frame and is fixedly connected to it, the at least one drive means being in drive-force-transmitting engagement with the driven means, the drive-force-transmitting engagement lying in the direction of the guide axis in the longitudinal region of the supporting section. As a result, the durability of the drive-force-transmitting engagement can be ensured. The just mentioned arrangement of the drive-force-transmitting engagement in the longitudinal region of the supporting section can therefore prevent undesirable ending of the drive-force-transmitting engagement by it preventing, for example, a physical separation of the drive means and the driven means by means of lifting off or the like.

Preferably, the drive means and the driven means form a transmission comprising toothed elements; particularly preferably the drive means is a gearwheel, which is in combing engagement with a toothed rack as the driven means. Alternatively, however, it is also conceivable for a friction wheel to be used as the drive means, the drive-force-transmitting engagement then being a frictional engagement.

Since the above-described load-handling means imparts particular value to an industrial truck, independent protection is also sought for an industrial truck with such a load-handling means, in particular a side-shifting device. Such an industrial truck also achieves the object mentioned at the outset.

Although the present invention will be described below substantially with reference to the example of a side-shifting device, the invention is not restricted to side-shifting devices but can be applied to any other desired load-handling means.

Figure 2:
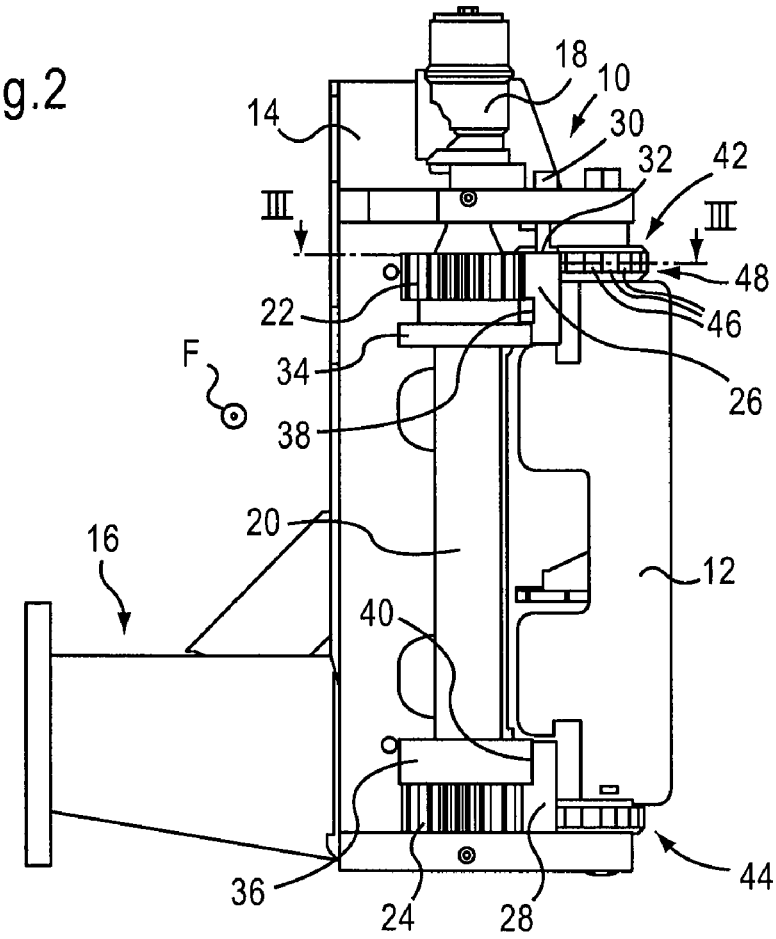
Figure 3:
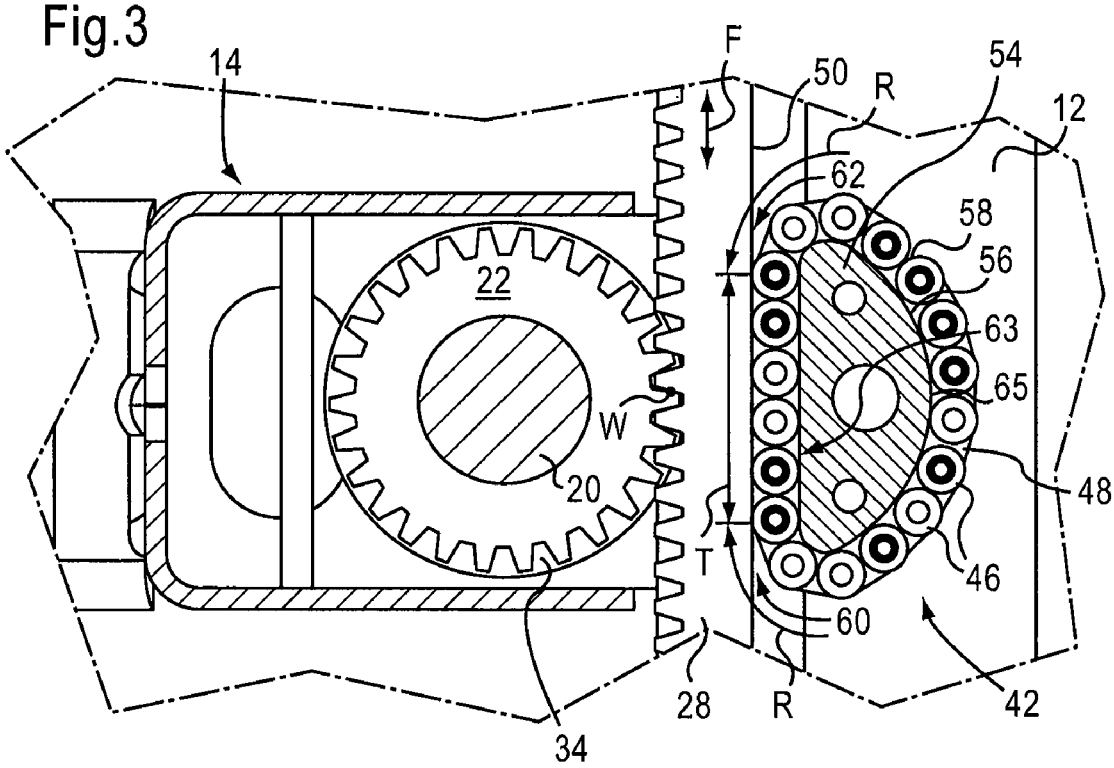
Figures 4, 5, 6:
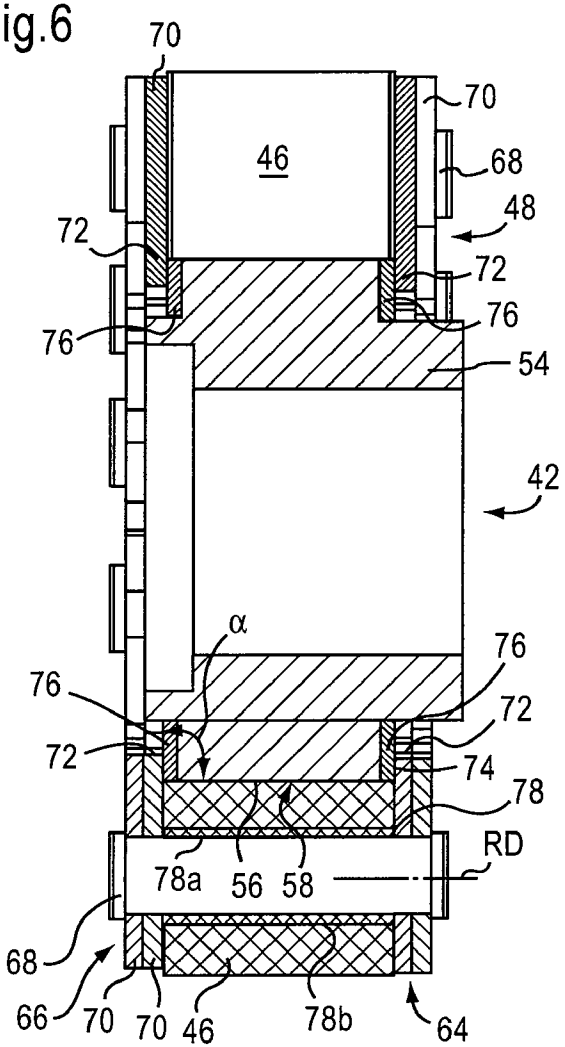

The present invention will be explained in the text which follows with reference to an exemplary embodiment, which is illustrated in the attached drawings, in which:

FIG. 1 shows a perspective illustration of a side-shifting device as an embodiment according to the invention of a load-handling means in accordance with the present invention, FIG. 2 shows a side view of the side-shifting device from FIG. 1, FIG. 3 shows a sectional view along the section plane III-III from FIG. 2, FIG. 4 shows a perspective view of a guide component part comprising a shaped component part with a rolling track and a slat chain rolling thereon, FIG. 5 shows a plan view of the guide component part from FIG. 4, and FIG. 6 shows a sectional view along the section plane VI-VI from FIG. 5.

In order to explain a side-shifting device as an inventive exemplary embodiment of a load pickup means of the present invention, reference is made to FIGS. 1 and 2. In FIGS. 1 and 2, a side-shifting device is overall denoted by 10. The side-shifting device 10 comprises a side-shifting frame 12, which is provided fixedly on an industrial truck (not illustrated), and an outrigger 14, which is capable of performing a translatory movement on the side-shifting frame 12 relative thereto along a guide direction identified by the double arrow F. The outrigger 14 can be connected to a load pickup means, such as a fork, for example, via a further frame structure 16 (see FIG. 2).

The outrigger 14 has a drive motor 18, on whose drive shaft 20 a first gearwheel 22, which is closer to the drive motor, and a second gearwheel 24, which is more remote from the drive motor, are provided such that they are fixed against rotation, which gearwheels roll in combing fashion on correspondingly associated toothed racks 26 and 28, respectively, of the side-shifting frame 12. As a result of rotation of the gearwheels 22 and 24, driven by the drive motor 18, the outrigger 14 can therefore be moved relative to the side-shifting frame 12 along the double arrow F.

The outrigger 14 is guided on the side-shifting frame 12 via a plurality of rollers. A first roller 30 supports the outrigger 14 on a first roller track 32, which is formed on the toothed rack 26, in the direction of action of the force of gravity.

Furthermore, a second roller 34, which is closer to the drive motor, and a third roller 36, which is more remote from the drive motor, are provided on the drive shaft 20 in such a way that they are capable of rotating relative to the drive shaft 20 in the vicinity of the gearwheels 22 and 24, respectively, and roll on associated roller tracks 38 and 40, respectively, which are formed on the toothed racks 26 and 28, respectively. The second and the third rollers 34, 36 support tipping moments about a tipping axis running parallel to the double arrow F.

Furthermore, a first guide component part 42, which is closer to the drive motor, and a second guide component part 44, which is more remote from the drive motor, are provided on the outrigger 14. The guide component parts 42 and 44 have an identical design, for which reason it is sufficient below merely to describe the first guide component part 42 in detail.

The first guide component part 42 has a plurality of substantially identical rollers 46 as the rolling bodies. The rollers 46 are assembled to form a continuous slat chain 48.

As can be seen in FIG. 1, the rollers 46 of the slat chain 48 of the first guide component part 42 roll on a guide track 50, which is formed on the toothed rack 26 on its side pointing away from the toothed portion. Likewise, the rollers of the second guide component part roll on a guide track 52 of the second toothed rack 28. The toothed portion and the guide track 52 are formed on opposite sides on the second toothed rack 28 as well.

FIG. 3 illustrates the guide component part 42 in section. The slat chain 48 surrounds a shaped component part 54, which has a closed circulating rolling track 56, on whose rolling face 58 the rollers 46 of the slat chain 48 rest in touching contact and roll in circulatory fashion in the event of a relative movement of the outrigger 14 and the side-shifting frame 12.

The cross section shown in FIG. 3 through the guide component part 42 shows that some of the circulating rollers 46, namely those which are in touching contact with the guide track 50, form a supporting section T. In this supporting section T, the load acting on the guide component part 42 is distributed over in total six rollers 46 in the example illustrated in FIG. 3, with the result that each individual roller only experiences a very low surface pressure. The same applies to the surface pressure acting on the guide track 50.

It should be noted that the rolling point W at which the gearwheel 22 instantaneously rolls on the toothed rack 28 lies in the same longitudinal section as the supporting section T, when viewed in the guide direction F. This makes it possible to prevent the gearwheel 22 from lifting off from the toothed rack 28 and coming out of combing engagement.

As a result of the extension of the supporting section in the guide direction F, it is possible to use the guide component part 42 to prevent the outrigger 14 from tipping about a tipping axis, which is parallel to the longitudinal direction of the drive shaft 20, in the event of driving, in particular accelerated or delayed driving.

Since it is temporarily possible for the outer (in the guide direction F) rollers 46 of the supporting section T to come out of engagement with the guide track 50, the movement range of the outrigger 14 relative to the side-shifting frame 12 can be extended in comparison with the prior art in the guide direction F.

The shaped component part 54 has openings in order to make it possible to fix the guide component part 42 in a simple manner via the shaped component part 54 and in order to reduce the mass to be moved of the guide component part 42.

The remaining region of the circulating slat chain 48, which does not belong to the linear supporting section T, forms a return section R, which is merely indicated in FIG. 3. In this return section R, the rolling bodies 46 which have just left the supporting section T are supplied to this supporting section again. If the outrigger 14 in FIG. 3 moves, for example, upwards in the direction of the double arrow F, the rollers 46 of the slat chain 48 circulate around the shaped component part 54 in the anticlockwise direction and in the process roll both on the guide track 50 of the toothed rack 28 and on the rolling track 56 of the shaped component part 54. In this case, the rolling bodies 46 emerge from the supporting section T at the end region 60 thereof and enter the supporting section T again at the end region 62. In this case, the end region 60 therefore forms an outlet end region and the end region 62 forms an inlet end region of the supporting section T. In the event of a relative movement of the outrigger 14 in relation to the side-shifting frame 12 in the opposite direction, the movement relationships of the rollers 46 are precisely reversed.

As can be seen in FIG. 3, a linear rolling track section 63 is associated with the supporting section T, while a curvilinear rolling track section 65 is associated with the return section. The rolling track section 65, in which there are more rollers than in the linear track section 63, has different radii of curvature. In its two regions close to the end regions 60 and 62 of the supporting section T, the curvilinear track section 65 is more severely curved than in the section lying between these regions.

FIG. 4 illustrates the guide component part 42 in a perspective view. The slat chain 48 has two substantially parallel rows of slats 64 and 66, between which the rollers 46 of the slat chain 48 are accommodated. At each longitudinal end of a roller 46, said roller is connected in each case to two slats 70 by means of a bolt 68. The slats 70 of the two rows of slats 64 and 66 have an identical design, which simplifies the manufacture of the slat chain 48.

At their edge regions pointing towards the shaped component part 54, the slats 70 have guide tabs 72 protruding towards the shaped component part 54. This can be seen better in the plan view in FIG. 5.

The slats of the row of slats 64 which are closer to the roller rest with their guide tabs 72 on a first resting face 74 of the shaped component part 54. The resting situation for the parallel row of slats 66 is identical, with the result that the rolling track 56 is held in an form-fitting manner with its rolling face 58 between the respective slats 70 of the rows of slats 64 and 66 which are closer to the roller. The slats 70 are shaped by means of stamping, with the result that the guide tabs 72 are formed integrally on them. This can be seen in detail in FIG. 5.

The cross section in FIG. 6 shows that the circulating resting faces 74 of the shaped component part 54 are formed by means of plastic layers 76 of polytetrafluoroethylene or of other plastics with sliding properties which are known to be good. It should be mentioned that the resting situation of the slats 70 of the two rows of slats 64 and 66 is identical.

The rolling face 58, when viewed in a section plane orthogonal to the rolling direction at the rolling location of a roller 46, encloses an angle $\alpha$ with the resting face 74, which angle $\alpha$ can be a right angle or can be conventional draft angles larger than a right angle, for example 91° to 100°.

The rollers 46 are mounted, with the intermediate arrangement of a sliding-bearing sleeve 78, on the bolts 68 associated with them so as to rotate about their roller axis RD. The sliding-bearing sleeve 78, which provides a radially inner sliding-bearing face 78*a* and a radially outer sliding-bearing face 78*b*, is preferably made from plastic, particularly preferably made from the same plastic as the component parts 76 providing the resting faces 74. As a result of the plastic sliding guides provided on the guide component part 42, the guide component part 42 has very good emergency-running properties if a supply of lubricant is interrupted.

It should be added with reference to FIG. 5 that the slats 70 have a concave contour 80 between their guide tabs 72, which makes it possible for the slats 70 to travel around small radii of curvature close to the end regions 60 and 62 despite the fact that the guide tabs 72 rest in guiding fashion on the resting faces 74 themselves.

The invention claimed is:

1. Load-handling apparatus comprising:

a frame;

a load movement component part accommodated on said frame in such a way that the load movement component part is capable of movement relative to the frame; and a plurality of rolling bodies that guide the load movement component part on the frame along a guide axis for the relative movement, wherein the plurality of rolling bodies comprises at least one arrangement of circulating rolling bodies having:

a supporting section on which the rolling bodies, in the event of a relative movement of the frame and the load movement component part, roll along:

a guide track, which is fixedly connected to one of the frame and the load movement component part; and a rolling track, which is fixedly connected to the other one of the frame and the load movement component part; and a return section in which the rolling bodies, during the relative movement of the frame and the load movement component part, move from an outlet end region of the supporting section towards an inlet end region of the supporting section;

wherein the at least one arrangement of circulating rolling bodies surrounds a shaped component part having the rolling track on which the circulating rolling bodies roll in the event of a relative movement of the frame and the load movement component part; and wherein the rolling track consists of a linear track section associated with the supporting section and a track section that is entirely curvilinear associated with the return section.

2. Load-handling apparatus according to claim 1, wherein the rolling track is continuous and at least two thirds of the circulating rolling bodies are in touching contact with the rolling track.

3. Load handling apparatus of claim 2, wherein all of the circulating rolling bodies are in touching contact with the rolling track.

4. Load-handling apparatus according to claim 1, wherein the at least one arrangement of circulating rolling bodies is at least one rolling body chain.

5. Load-handling apparatus according to claim 4, wherein the rolling body chain is a slat chain.

6. Load-handling apparatus according to claim 5, wherein the slat chain has guide element configured to engage with an opposing guide element on the shaped component part for the purpose of guiding the slat chain on the shaped component part in the rolling direction.

7. Load-handling apparatus according to claim 6, wherein at least some of the slats of the slat chain have a guide tab protruding towards the shaped component part.

8. Load-handling apparatus according to claim 7, wherein the slat chain has two parallel rows of slats between which the rolling bodies of the slat chain are arranged, and at least some of the slats of each row of slats having guide tabs so that at least one section of the rolling track of the shaped component part is located between the guide tabs of slats of the two rows of slats.

9. Load-handling apparatus according to claim 7, wherein the shaped component part has at least one resting face for the guide tabs to rest thereon.

10. Load-handling apparatus according to claim 9, wherein the shaped component part has two resting faces, which are arranged at a distance from one another, each resting face having associated guide tabs of a row of slats.

11. Load-handling apparatus according to claim 9, wherein the at least one resting face is formed from plastic.

12. Load handling apparatus of claim 11, wherein the plastic is polytetrafluoroethylene.

13. Load handling apparatus according to claim 9, where the resting face is bent back at an angle with respect to the rolling face of the rolling track.

14. Load-handling apparatus according to claim 1, further comprising a sliding-bearing face made from plastic on which at least one of the rolling bodies is mounted so as to rotate about a rolling-body axis of rotation.

15. Load-handling apparatus according to claim 14, further comprising an intermediate arrangement of a sliding-bearing sleeve on a bolt that accommodates at least one of the rolling bodies.

16. Load-handling apparatus according to claim 1, wherein the load-handling apparatus is a side-shifting device with a shifting frame as the frame and with an outrigger as the load movement component part.

17. Load-handling apparatus according to claim 16, further comprising:

at least one drivable drive element provided on a component part of one of the shifting frame and the outrigger, and a driven element provided on a component part of the other one of the shifting frame and the outrigger and is fixedly connected to the component part of the other one, wherein the at least one drive element is in drive-force-transmitting engagement with the driven element, and the drive-force-transmitting engagement lies in the direction of the guide axis in a longitudinal region of the supporting section.

18. Load handling apparatus of claim 17, wherein the drivable drive element is a gearwheel, and the driven element is a toothed rack.

19. Load handling apparatus of claim 17, wherein the one is the outrigger, and the other one is the shifting frame.

20. Industrial truck having a load-handling apparatus according to claim 1.

21. Load handling apparatus of claim 1, wherein the at least one arrangement of circulating rolling bodies is at least one a continuous rolling body chain.

22. Load-handling apparatus comprising:

a frame;

a load movement component part accommodated on said frame in such a way that the load movement component part is capable of movement relative to the frame; and a plurality of rolling bodies that guide the load movement component part on the frame along a guide axis for the relative movement, wherein the plurality of rolling bodies comprises at least one arrangement of circulating rolling bodies having:

a supporting section on which the rolling bodies, in the event of a relative movement of the frame and the load movement component part, roll along:

a guide track, which is fixedly connected to one of the frame and the load movement component part; and a rolling track, which is fixedly connected to the other one of the frame and the load movement component part; and a return section in which the rolling bodies, during the relative movement of the frame and the load movement component part, move from an outlet end region of the supporting section towards an inlet end region of the supporting section;

wherein the at least one arrangement of circulating rolling bodies surrounds a shaped component part having the rolling track on which the circulating rolling bodies roll in the event of a relative movement of the frame and the load movement component part; and wherein the at least one arrangement of circulating rolling bodies is a slat chain, of which at least some slats are formed as a guide element configured to engage with an opposing guide element on the shaped component part for the purpose of guiding the slat chain on the shaped component part in the rolling direction.

23. Load-handling apparatus according to claim 22, wherein at least some slats of the slat chain are asymmetrical and have a guide tab protruding towards the shaped component part.

24. Load-handling apparatus according to claim 22, wherein the slat chain has two parallel rows of slats between which the rolling bodies of the slat chain are arranged, and at least some of the slats of each row of slats having guide tabs so that at least one section of the rolling track of the shaped component part is sandwiched between the guide tabs of slats of the two rows of slats.

25. Load-handling apparatus according to claim 24, wherein the shaped component part has two resting faces, which are arranged at a distance from one another, each resting face having associated guide tabs of a row of slats.

26. Load handling apparatus according claim 25, wherein each of the two resting faces encloses an angle with a rolling face of the rolling track which is a right angle or up to 10° larger than a right angle.

27. Load-handling apparatus according to claim 22, wherein the shaped component part has at least one resting face for the guide tabs to rest thereon.

28. Load-handling apparatus according to claim 27, wherein the at least one resting face is formed from plastic.

29. Load handling apparatus of claim 28, wherein the plastic is polytetrafluoroethylene.

* * * * *